US007032684B2

(12) United States Patent
Muuttonen et al.

(10) Patent No.: US 7,032,684 B2
(45) Date of Patent: Apr. 25, 2006

(54) METHOD OF OPENING JOINTS BETWEEN DRILLING COMPONENTS, AND ROCK DRILL

(75) Inventors: Timo Muuttonen, Siuro (FI); Pekka Salminen, Tampere (FI)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 10/312,532

(22) PCT Filed: Jun. 18, 2001

(86) PCT No.: PCT/SE01/01382

§ 371 (c)(1),
(2), (4) Date: Mar. 18, 2003

(87) PCT Pub. No.: WO02/01041

PCT Pub. Date: Jan. 3, 2002

(65) Prior Publication Data

US 2003/0155140 A1 Aug. 21, 2003

(30) Foreign Application Priority Data

Jun. 27, 2000 (FI) ..... 20001522

(51) Int. Cl.
*E21B 19/16* (2006.01)

(52) U.S. Cl. ..... 173/4; 173/11; 173/206; 173/212

(58) Field of Classification Search ..... 173/1, 173/4, 9, 210, 212, 200, 206, 105, 106; 123/46 SC, 123/46 H, 47 R, 47 K
See application file for complete search history.

(56) References Cited

U.S. PATENT DOCUMENTS

| | | | | |
|---|---|---|---|---|
| 2,791,097 | A * | 5/1957 | Smith | 173/212 |
| 3,670,826 | A * | 6/1972 | Hanson et al. | 173/4 |
| 4,073,350 | A * | 2/1978 | Eklof et al. | 173/212 |
| 4,194,579 | A | 3/1980 | Bailey et al. | |
| 4,262,755 | A * | 4/1981 | Kuhn | 173/210 |
| 4,343,368 | A * | 8/1982 | Fadeev et al. | 173/212 |
| 4,494,614 | A * | 1/1985 | Eklof | 173/200 |
| 4,508,017 | A * | 4/1985 | Montabert | 173/200 |
| 4,593,768 | A * | 6/1986 | Eklof | 173/200 |
| 4,601,349 | A * | 7/1986 | Arentsen | 173/200 |
| 4,624,325 | A * | 11/1986 | Steiner | 173/212 |
| 4,699,223 | A * | 10/1987 | Noren | 173/10 |
| 4,871,035 | A * | 10/1989 | Ekwall | 173/212 |
| 4,934,465 | A * | 6/1990 | Salmi et al. | 173/210 |
| 4,993,504 | A * | 2/1991 | Rodert et al. | 173/105 |
| 5,351,763 | A | 10/1994 | Muuttonen | |

(Continued)

FOREIGN PATENT DOCUMENTS

WO WO97/32109 9/1997

*Primary Examiner*—Scott A. Smith
(74) *Attorney, Agent, or Firm*—Drinker Biddle & Reath LLP

(57) ABSTRACT

A rock drill includes a string of components interconnected by screw threads and connected to a shank. A percussion piston is reciprocated against the shank during a drilling operation, while a support device applies axial support to the rear of the shank, to enhance the drilling action. When the components are being unscrewed, the percussion piston is actuated to strike the rear end of the drill string, after the support device has at least partially released the axial support of the shank, to enable tensile stress to be generated in the components by the percussive impacts to facilitate unscrewing of the components.

6 Claims, 3 Drawing Sheets

U.S. PATENT DOCUMENTS 5,361,831 A 11/1994 Young
5,479,996 A * 1/1996 Jonsson et al. ..... 173/212
5,520,254 A * 5/1996 Weber ..... 173/206
5,875,857 A * 3/1999 Leppanen et al. ..... 173/212
5,896,937 A * 4/1999 Kaneko ..... 173/105
5,944,120 A * 8/1999 Barden ..... 173/212
6,186,246 B1 2/2001 Muuttonen et al.
6,209,661 B1 * 4/2001 Muona ..... 173/1
6,273,199 B1 * 8/2001 Kiikka et al. ..... 173/105
6,318,478 B1 * 11/2001 Kaneko ..... 173/210

* cited by examiner

METHOD OF OPENING JOINTS BETWEEN DRILLING COMPONENTS, AND ROCK DRILL

TECHNICAL BACKGROUND

The invention relates to a method of opening joints between drilling components in a rock drill which is fed with respect to a feeding beam during drilling and which comprises a frame, a percussion device arranged in the frame. The conventional percussion device comprises a percussion piston which moves in the longitudinal direction, a shank which is arranged in the axial extension of the percussion piston for being struck by the percussion piston and to which the necessary drilling components, such as drill rods, a drill bit and the like are attached to form drilling equipment, and a rotating device which by means of a rotating bushing rotates the shank. The conventional rock drill further comprises at least one axial piston, which is positioned rearwardly of the shank and arranged to move in the axial direction by means of the pressure of a pressure medium fed onto its back surface during drilling, the axial piston acting on the shank by supporting it towards the front part of the drilling machine. The conventional method comprises supporting at least part of the drilling equipment against a supporting surface when threaded joints of the drilling components attached to the shank are opened and striking the drilling equipment with the percussion device, after which the shank is rotated by the rotating device in a direction opposite to normal drilling to open the desired joints.

The invention further relates to a rock drill which comprises a frame, a percussion device provided with a percussion piston which moves in the longitudinal direction, a shank which is arranged in the axial extension of the percussion piston, which is arranged to strike the rear end of the shank, and a rotating device which is arranged to rotate the shank by a rotating bushing arranged around the shank, and drilling equipment consisting of drilling components attached to the front end of the shank. The conventional drilling machine comprises at least one axial piston, which is arranged rearwardly of the shank, there being a pressure channel which extends rearwardly of the axial piston and allows feeding of a pressure medium rearwardly of the axial piston to move the axial piston in the axial direction, the axial piston being arranged to support the shank in the axial direction during drilling.

A drilling machine that comprises a percussion device and a rotating device is used in rock drilling. At the front end of the drilling machine there is a shank which is struck by a percussion piston of the percussion device and rotated by the rotating device during drilling. In the extension of the shank there are drilling components, such as one or more drill rods and a drill bit. The drill bit is the outermost part and comprises buttons for working the rock. The drilling components thus constitute the drilling equipment that is attached to the drilling machine and transmits the percussion force and the rotating force from the shank to the rock to be drilled. The drilling components are attached to the shank and further to other drilling components usually by means of a threaded joint. For example, when the drill bit is changed or drill rods are added/removed between the drill bit and the shank, joints have to be opened. When threaded joints between the drilling components are opened, the shank is rotated by a rotating motor in a direction opposite to normal drilling. To facilitate opening of a joint, the drilling equipment can be struck by the percussion device. In the case of damaged or stuck joints, in particular, it is very common to apply such striking in opening.

Finnish patent no. 98 401 describes a rock drill where the shank can be moved forward by means of axial pistons provided rearwardly of the shank when drilling is adjusted. In that case the shank is supported from behind either directly or by means of a bushing. The pressure acting rearwardly of the axial pistons is changed and thereby the travel of the pistons is adjusted and thus also the position of the shank. There are several axial pistons which are arranged in groups with different travel so that axial pistons with a longer travel can move over the optimal percussion point, to the front of it. It is a known fact that a stroke generated by the percussion piston produces a stress pulse that is reflected back from the rock. In the solution according to the publication, the pulse reflected from the rock is received by axial pistons that extend to the front of the optimal percussion point, and thus the backward movement of the shank and the drilling equipment is dampened. One purpose of this solution is to support the shank and the drilling equipment during the whole duration of drilling by means of axial pistons included in an axial bearing, in which case constant compression stress acts on the drilling equipment, which together with rotation continuously tightens the threaded joints during normal drilling, thus ensuring that the joints between the drilling components remain fastened. This way problems caused by loosened joints can be avoided. The threaded joint is typically damaged by vibration of a loosened joint. In the use of the drilling machine disclosed in the publication it has been noted that it is difficult to open the joints of the drilling components because as the drilling components are struck off, the axial bearing tries to ensure rock contact against the bottom of the drilling hole by supporting the shank during striking, in which case compression stress is ensured in the drilling equipment in the same way as in normal drilling.

OBJECT OF THE INVENTION

The object of the invention is to provide a new improved method for opening joints of drilling components and a rock drill according to the method.

SUMMARY OF THE INVENTION

The method of the invention is characterized by reducing the pressure of the pressure medium that pushes the axial piston towards the front end of the drilling machine when drilling components are struck off so that the shank and the drilling components in its extension are substantially not supported by the axial piston in the axial direction when drilling components are struck off, the compression stress caused in the drilling components by the stroke of the percussion piston being reflected at least partially from the front end of the drilling equipment, whereby said return pulse generates tensile stress in the drilling components and their joints.

The rock drill according to the invention is characterized in that the rock drill comprises means for reducing the pressure of the pressure medium leading to the axial piston when drilling components are struck off by a percussion device so that the shank and the drilling equipment are substantially not supported by the axial piston in the axial direction when drilling components are struck off.

BRIEF DESCRIPTION OF THE DRAWINGS

The invention will be described in greater detail in the accompanying drawings, in which FIG. 1*a* schematically illustrates a prior art rock drill where the solution according to the invention can be applied.

DETAILED DESCRIPTION OF THE INVENTION

Figures 1A, 1B:
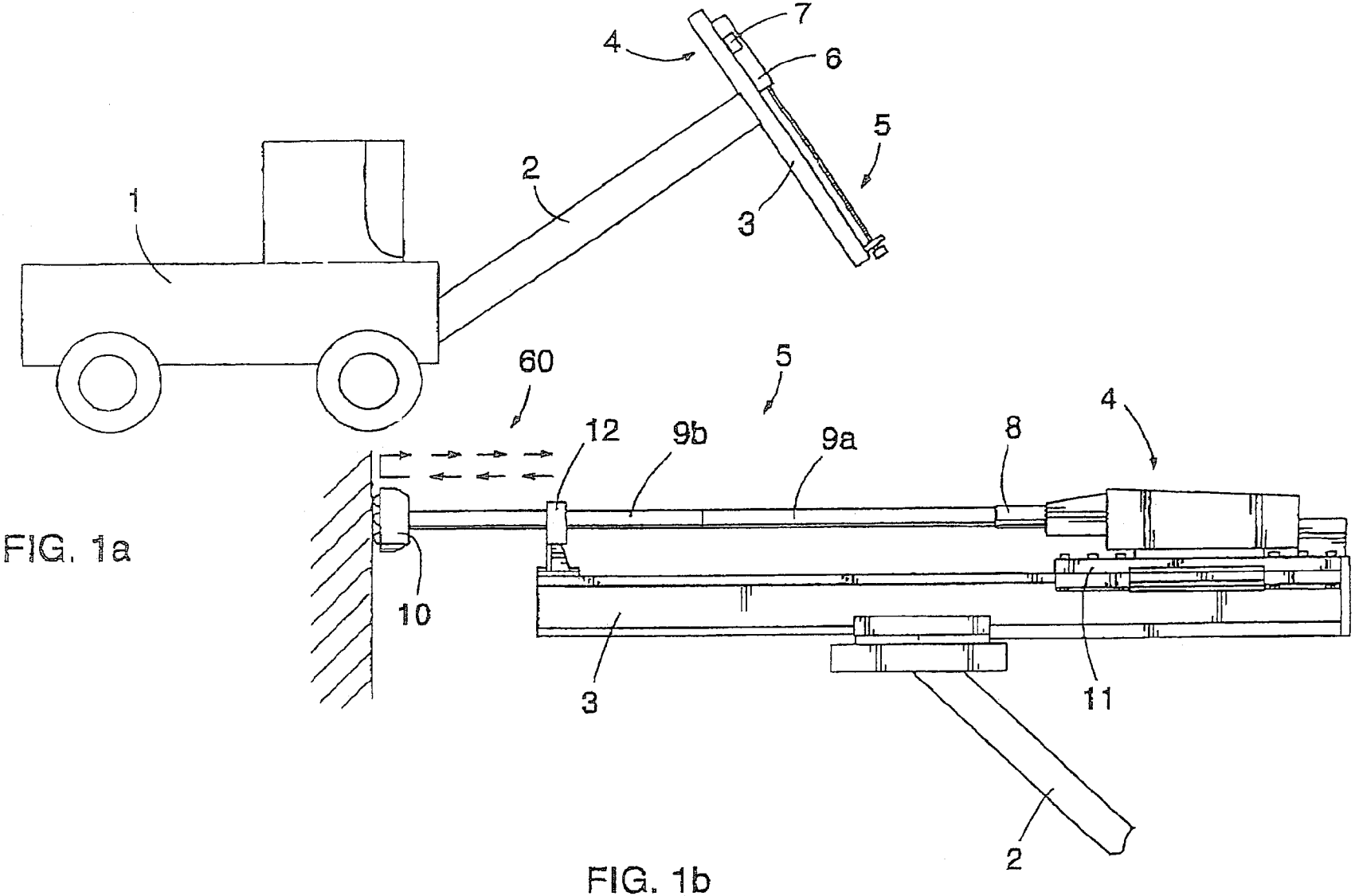
FIG. 1*b* is a schematic side view of the rock drill according to the invention and drilling equipment attached to it, FIG. 2 a schematic sectional side view of a detail of the rock drill according to the invention.

FIG. 1*a* is a simplified view of a rock drilling device, which comprises a movable base 1, a boom 2 and a feeding beam 3 provided at the free end of the boom. The rock drill 4 can be moved with respect to the feeding beam and the necessary drilling equipment 5 is attached to the shank of the rock drill. The rock drill comprises a percussion device 6 for striking the shank and a rotating device 7 for rotating the shank. The shank transmits the percussion force and the rotational force to the drilling equipment, which transmits them further to the rock to be drilled.

In the solution shown in FIG. 1*b* the drilling equipment 5 comprises a first drill rod 9*a* attached to the shank 8 and a second drill rod 9*b* attached to the extension of the shank. Furthermore, a drill bit 10 is attached to the outermost end of the drill rod string thus formed. Usually several extension rods are employed in drilling, but sometimes only one drill rod, in which case a drill bit is attached detachably or fixed to one end of the drill rod. In this application the drill rods, the drill bit and the like attached to the shank extension are commonly called drilling components. The rock drill 4 is mounted onto the feeding beam by means of a carriage 11, or alternatively, if the structure of the drilling machine is rigid, it can be mounted in such a manner that it is movable with respect to the feeding beam 3 directly by slide blocks. The drilling machine is moved by feeding means known per se, such as pressure-medium-operated feed cylinders or the like, and by necessary power transmission members, such as wires. At the front end of the feeding beam or close to it, usually in connection with the front controller, there is 'grip' 12 which enables clamping of the drilling component and holding of it when the joints between the drilling components are opened. A threaded joint is used between the drilling components, and the joint is opened by rotating the shank by the rotating motor in a direction opposite to normal drilling. In that case the grip generates counter torque for rotation, and thus the joint of the rotating drilling component in the grip opens. The grip may be generated by pressure-medium-operated clamping jaws or the like between which the drilling component is locked so that it cannot substantially move. The grip is known to a person skilled in the art and thus its detailed structure needs not be described here. Detached drilling components can be handled by suitable manipulators or the like between the component magazine and the drilling machine.

In FIG. 1*b* arrows 60 illustrate how the stroke generated by the percussion piston produces compression stress in the drilling equipment 5, which advances like a wave from the shank towards the drill bit 10. Since the drill bit is not supported against the rock during striking in the same ways as in normal drilling, at least part of the compression stress is reflected back from the front surface of the drill bit and proceeds towards the shank in the desired manner as stress of the opposite sign, i.e. as tensile stress. On the other hand, during normal drilling as good rock contact of the drill bit as possible is to be maintained by means of the axial bearing so that the drill bit penetrates into the rock as well as possible and to avoid generation of disadvantageous tensile stress in the drilling equipment.

Figure 2:
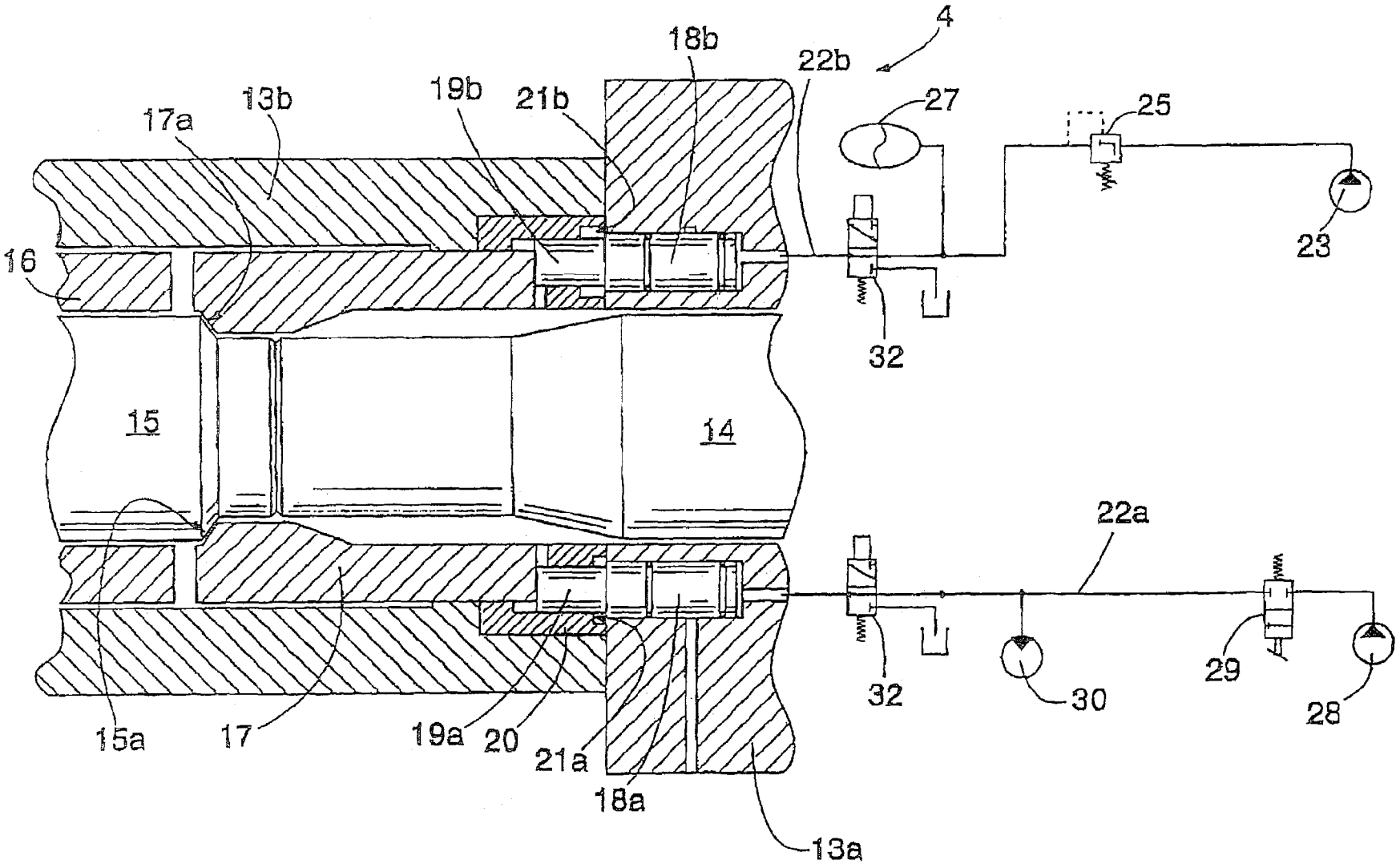

FIG. 2 illustrates a section of a rock drill 4 known per se. The rock drill comprises a frame, which in this case consists of frame parts 13*a* and 13*b* that are joined together. The percussion device includes a percussion piston 14, which due to the influence of the percussion device moves to and fro in the axial direction and strikes the shank 15. The shank is in the axial extension of the percussion piston at the front end of the rock drill. Furthermore, the shank is rotated by rotating a rotating bushing 16 around the shank by means of the rotating motor. The shank can move with respect to the rotating bushing in the axial direction. The structure and function of the percussion apparatus, rotating motor and the rotating bushing are known per se. The shank is supported axially rearwardly by a supporting bushing 17 to keep the shank in a suitable position in the axial direction to transmit the stroke and dampen the return movement, which follows the stroke. The expressions "behind" and "rearwardly of" refer to a position in relation to the normal drilling direction. The supporting bushing is provided with a slanted supporting surface 17*a* which touches the corresponding supporting surface 15*a* of the shank. Rearwardly of the supporting bushing there are several axial support pistons 18*a* and 18*b* arranged around the percussion piston. In the solution shown in the figure the axial pistons generate supporting force, which is transmitted to the supporting bushing 17 by means of bearing members 19*a* and 19*b* arranged coaxially with the pistons. For keeping the bearing members at the pistons there is a separate positioning bushing 20 positioned rearwardly of the supporting bushing. The positioning bushing also comprises limiting surfaces 21*a* and 21*b* that limit the movement of the axial pistons towards the front end of the drilling machine. If the support pistons 18*a*, 18*b* are arranged to act directly on the supporting bushing without any bearing members 19*a*, 19*b* or the like, the forward movement of the axial pistons can be limited by means of a separate limiting bushing or limiting surfaces provided in the frame. The axial pistons are located in cylinder spaces provided in the frame or in a separate member. Pressure channels 22*a* and 22*b* lead to the cylinder spaces. During drilling the drilling machine as a whole is fed with a certain force against the rock. If the shank is to be supported by the pistons 18*a*, 18*b*, the total force via these pistons must exceed the feeding force. If this force does not exceed the feeding force the pistons will not support the shank but instead the pistons will be in their rearmost position.

In the construction shown in the figure there are several axial pistons which are divided into groups to form at least two separate piston groups with different travel or stroke to the front end of the drilling machine. As can be seen, the travel allowed for the upper piston 18*b* by the limiting surface 21*b* is longer than that allowed for the lower piston 18*a* by the limiting surface 21*a*.

FIG. 2 further illustrates a simplified hydraulic coupling of the axial bearing. Pressure medium is supplied from a pump 23 along a pressure channel 22*b* to a pressure reducing valve 25. A hydraulic accumulator 27 is preferably connected to the pressure channel 22*b*. The arrangement further comprises a second pump 28, which feeds pressure medium via a regulating valve 29 to the percussion apparatus 30, which in turn generates the to and fro movement of the percussion piston 14. The pressure medium that drives the percussion apparatus 30 is also connected to act directly on the axial pistons 18*a* via the pressure channel 22*a*.

In the situation shown in the figure the regulating valve 29 is in a first position where no pressure medium is let from the pump into the percussion apparatus 30, and thus pressure does not act on the axial pistons 18*a*. The pressure of the pressure medium from the pump 23 is reduced in the pressure reducing valve 25, after which it acts on the axial pistons 18*b*. Consequently, the total pressure of the pressure medium acting rearwardly of the axial pistons 18*a* and 18*b* during striking is higher than the feed force of the rock drill, and therefore sufficient for keeping the shank in the optimal striking position, where the rock drill functions in the manner known per se. Instead of separate pumps 23 and 28, it is naturally possible to use one common pump. In that case e.g. the pressure medium channel from the pump 28 is connected to the channel leading to the valve 25.

The pressure channel 22*b* is further provided with a valve 32 for cutting off the pressure acting rearwardly of the axial pistons 18*b* when joints between the drilling components are struck off by means of the percussion device. When the valve 32 is in the lower position, no pressure is fed rearwardly of the axial pistons 18*b*, but the pressure is released into a tank. In that case the axial pistons with a longer travel do not support the drilling equipment when joints are struck off, but the pulses caused by the strokes are reflected to the drilling equipment as tensile stress, which opens stuck joints between the drilling components. Furthermore, there may be a valve 32 arranged in the pressure channel 22*a* of the axial pistons 18*a* with a shorter travel for acting on the pressure which acts rearwardly of the pistons 18*a* during striking.

The pressure acting rearwardly of the axial pistons is supplied to the tank during striking, and thus zero or ambient pressure acts on the pistons, or a low pressure due to filters and similar throttling components in the return line. Alternatively, the pressure space rearwardly of the axial pistons is not connected to the pressure line towards the tank but the support provided for the drilling equipment by the axial pistons can be reduced by reducing the pressure acting rearwardly of the pistons with respect to the value used in normal drilling e.g. by means of a pressure reducing valve. Also when the axial pistons do not actively support the drilling equipment, the striking produces the desired tensile stress in the drilling equipment.

In practice, the user of the device turns the rock drill into the striking position by means of an operating switch 41 provided in a control panel 40 described below in FIG. 3. As a result, the valve 32 moves into the lower position and normal drilling control 42 of the drilling machine is bypassed; yet the full striking power is obtained, if necessary.

Figure 3:
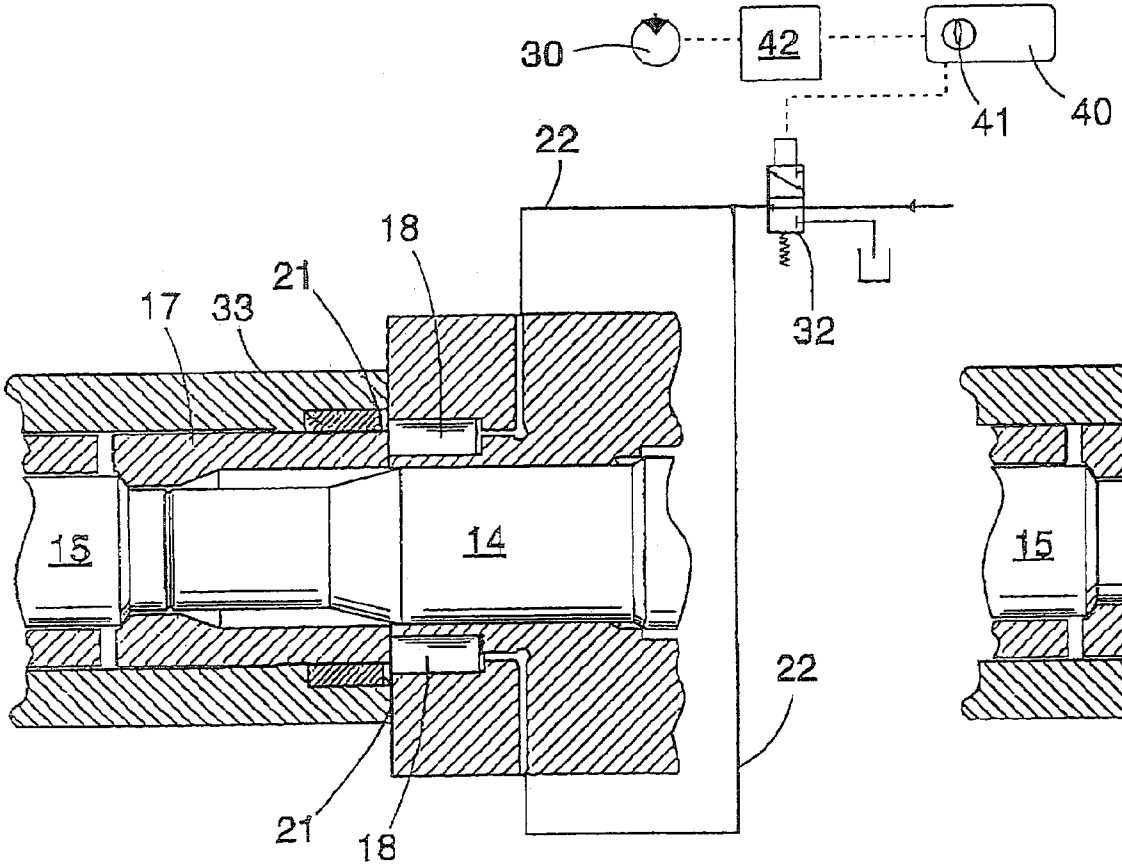

The rock drill and its axial bearing shown in FIG. 3 correspond to those of FIG. 2, except that the axial pistons 18 are in direct contact with the supporting bushing 17 without separate bearing members. Furthermore, in the solution of FIG. 3 all the axial pistons have the same travel. The movement of the axial pistons is restricted by means of a limiting bushing 33. In this solution the pressure is also reduced or eliminated altogether rearwardly of the axial pistons when joints of the drilling equipment are struck open by the percussion piston. Since the shank is not supported when joints are struck open, tensile stress is generated in the drilling equipment, which facilitates opening of the threaded joints.

Figure 4:
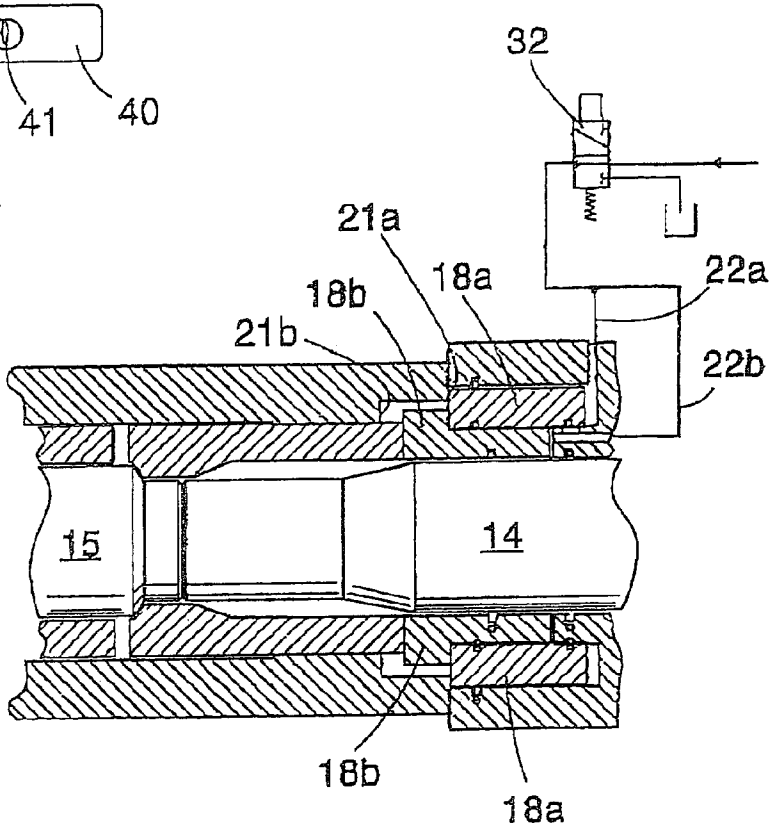
FIGS. 3 and 4 are schematic sectional views of the structure of two other respective rock drills according to the invention at the axial bearing.

FIG. 4 illustrates a further construction where the invention can be applied. The operating principle of the axial bearing is similar to that illustrated in FIG. 2, except that, instead of several separate cylinder-like axial pistons, bushing-like pistons are used which are arranged around the percussion piston coaxially. In this case the pistons 18*a* and 18*b* are arranged so that the inner piston 18*b* can be moved forwards to the counter surface 21*b* by means of the pressure fed from the pressure channel 22*b*. The piston 18*a* is positioned coaxially around the inner piston and pressure medium is supplied rearwardly thereof via the pressure channel 22*a*. Like in the constructions described above, the pressure is reduced or eliminated only rearwardly of the piston 18*b* or rearwardly of both pistons 18*a* and 18*b* as shown in the figure when the joints of the drilling components are struck open. It should be noted that the construction may comprise only one bushing-like piston. Furthermore, between the bushing-like piston and the counter surface of the shank there may be a suitable bushing or a similar element that transmits the forces.

The basic idea of the invention is that when joints are opened while employing strokes generated by a percussion device, i.e. striking, the pressure of axial pistons, or of some pistons included in the axial bearing of the drilling machine, is cut off or at least reduced so that the axial bearing does not axially support the shank and the drilling equipment during striking. Consequently the compression stress generated in the drilling equipment by the stroke of the percussion piston is reflected back from the front surface of the drill bit and produces a return pulse, which generates tensile stress in the drilling equipment so that opening of the joints of the drilling components becomes easier after striking. Striking can be performed in such a manner that the drill bit is against the rock or a similar supporting surface, whereby all the joints of the drilling equipment are subjected to the tensile stress, or alternatively, only desired drilling components are struck, in which case striking is performed when the drilling equipment is supported by grip 12 provided in the feeding beam.

An advantage of the invention is that by generating tensile stress in the drilling equipment the joints between the drilling components can be opened easier. Also stuck threaded joints open without difficulty. The invention improves the efficiency of the rock drill because the time needed for changing drilling components or for extending/dismantling a drill rod string is shorter and thus more time will be available for actual drilling. The arrangement according to the invention is rather simple to install afterwards in existing rock drills or rock drilling devices.

The drawings and the related description are only intended to illustrate the inventive concept. The details of the invention may vary within the scope of the claims.

The invention claimed is:

1. A rock drill comprising a frame, a percussion device provided with a reciprocable percussion piston which moves along a longitudinal path; a shank arranged in the longitudinal path to be struck in its rear end by the percussion piston, a rotating device including a rotating bushing arranged around the shank for rotating the shank, and drilling components attached to a front end of the shank; at least one axial support piston arranged rearwardly of the shank; a source of pressure medium; a pressure channel for conducting pressure medium from the source and against a rearwardly facing side of the axial support piston to push the axial support piston in a forward axial direction; the pressure channel arranged to conduct the pressure medium for applying a force to the at least one axial support piston solely in a forward direction; the axial support piston being arranged to support the shank in the axial direction during drilling; and a pressure reducing device including a valve movable between different positions for effecting drilling and striking-off operations including, during striking-off a position for only partially reducing the pressure of the pressure medium applied from the source to the axial support piston when drilling components are struck off by the percussion piston, wherein the drilling equipment is supported by the axial support piston by a pressure which is lower when the drilling components are struck off than during a drilling operation.

2. A rock drill according to claim 1, wherein the valve is arranged for communicating a rear of the axial support piston to a tank.

3. A rock drill according to claim 1, comprising a plurality of axial support pistons arranged in respective cylinder spaces oriented parallel with and around the percussion piston, at least one bearing member arranged in front of the axial pistons, and a supporting bushing oriented between a rear surface of the shank and the at least one bearing member, wherein forces from the axial support pistons are transmitted to the shank through the at least one bearing member and the supporting bushing.

4. A rock drill according to claim 1, wherein the axial support piston comprises a bushing arranged around the percussion piston.

5. A rock drill according to claim 1 wherein the valve comprises a pressure-reducing valve.

6. A rock drill according to claim 1, wherein the pressure channel supplies the pressure medium to the reciprocable percussion piston and the at least one axial support piston, and wherein the during striking-off the position of the pressure reducing device partially reduces the pressure of the pressure medium to the at least one axial support and not the pressure of the pressure medium to the reciprocable percussion piston.

* * * * *